US007733201B2

(12) United States Patent
Yoneshima et al.

(10) Patent No.: US 7,733,201 B2
(45) Date of Patent: Jun. 8, 2010

(54) STARTER INCLUDING ELECTROMAGNETIC SWITCH WITH PROTECTIVE COVER FOR PROTECTING TERMINALS

(75) Inventors: Hironori Yoneshima, Oobu (JP); Youichi Hasegawa, Kasugai (JP)

(73) Assignee: Denso Corporation, Kariya (JP)

( * ) Notice: Subject to any disclaimer, the term of this patent is extended or adjusted under 35 U.S.C. 154(b) by 112 days.

(21) Appl. No.: 11/984,190

(22) Filed: Nov. 14, 2007

(65) Prior Publication Data

US 2008/0117007 A1 May 22, 2008

(30) Foreign Application Priority Data

Nov. 16, 2006 (JP) ..... 2006-310632

(51) Int. Cl.
*H01H 67/02* (2006.01)

(52) U.S. Cl. ..... 335/126; 335/131

(58) Field of Classification Search ..... 335/126, 335/131; 439/810–814
See application file for complete search history.

(56) References Cited

U.S. PATENT DOCUMENTS

| | | | | |
|---|---|---|---|---|
| 2,862,110 | A * | 11/1958 | Bonvissuto | 307/10.3 |
| 4,116,077 | A * | 9/1978 | Mazzorana | 74/7 A |
| 4,674,344 | A * | 6/1987 | Kazino et al. | 74/7 A |
| 4,881,416 | A * | 11/1989 | Isozumi | 74/7 A |
| 5,130,586 | A * | 7/1992 | Miyaji et al. | 310/83 |
| 5,137,476 | A * | 8/1992 | Noble | 439/797 |
| 5,142,924 | A * | 9/1992 | Fasola et al. | 74/7 A |
| 5,245,304 | A * | 9/1993 | Zenmei | 335/126 |
| 5,245,881 | A * | 9/1993 | Rometsch | 74/7 A |
| 5,656,981 | A * | 8/1997 | Niimi et al. | 335/126 |
| 6,326,716 | B1 * | 12/2001 | Niimi et al. | 310/239 |
| 6,520,137 | B2 * | 2/2003 | Ooizumi et al. | 123/179.3 |
| 6,833,778 | B2 * | 12/2004 | Ohmi et al. | 335/131 |
| 6,914,504 | B2 * | 7/2005 | Kajino et al. | 335/126 |
| 6,930,576 | B2 | 8/2005 | Usami | |
| 6,965,172 | B2 | 11/2005 | Shimoyama et al. | |
| 7,116,196 | B1 | 10/2006 | Hirabayashi | |
| 2004/0032309 | A1 * | 2/2004 | Kajino et al. | 335/126 |
| 2004/0056743 | A1 * | 3/2004 | Maruhashi et al. | 335/126 |
| 2006/0220771 | A1 | 10/2006 | Hirabayashi | |

FOREIGN PATENT DOCUMENTS

| | | |
|---|---|---|
| JP | A-2003-208840 | 7/2003 |
| JP | A-2005-120873 | 5/2005 |
| JP | A-2006-286258 | 10/2006 |

* cited by examiner

*Primary Examiner*—Lincoln Donovan
*Assistant Examiner*—Alexander Talpalatskiy
(74) *Attorney, Agent, or Firm*—Oliff & Berridge, PLC

(57) ABSTRACT

According to the invention, a starter includes a motor and an electromagnetic switch. The electromagnetic switch includes a switch case, a movable contact, a fixed contact, a contact cover, an excitation coil, an excitation coil terminal, a motor terminal, and a protective cover. The excitation coil terminal has a first end, which is located inside the contact cover and electrically connected to the excitation coil, and a second end that protrudes outside the contact cover so as to be electrically connected to a power source. The motor terminal has a first end, which is located inside the contact cover and electrically connected to the fixed contact, and a second end that protrudes outside the contact cover and is electrically connected to the motor. The protective cover covers both the second end of the excitation coil terminal and the second end of the motor terminal, thereby protecting both the second ends.

6 Claims, 8 Drawing Sheets

STARTER INCLUDING ELECTROMAGNETIC SWITCH WITH PROTECTIVE COVER FOR PROTECTING TERMINALS

CROSS-REFERENCE TO RELATED APPLICATION

This application is based on and claims priority from Japanese Patent Application No. 2006-310632, filed on Nov. 16, 2006, the content of which is hereby incorporated by reference in its entirety into this application.

BACKGROUND OF THE INVENTION

1. Technical Field of the Invention

The present invention relates generally to starters for staring engines. More particularly, the invention relates to a starter for starting an engine, which includes an electromagnetic switch that has a protective cover for protecting terminals of the electromagnetic switch.

2. Description of the Related Art

Japanese Patent Application Publication No. 2006-286258, an English equivalent of which is U.S. Pat. No. 7,116,196 B1, discloses a starter electromagnetic switch that includes a movable contact, a pair of fixed contacts, a switch cover (or contact cover), a switch coil (or excitation coil), a switch terminal bolt, and a motor terminal. The switch cover covers the movable contact and has the fixed contacts fixed thereto facing the movable contact. The switch terminal bolt is fixed to the switch cover to supply electric power to the switch coil. The switch terminal bolt has a head portion insert-molded in the switch cover and a shaft portion that protrudes outside the switch cover so as to be electrically connected to a battery. The motor terminal is also fixed to the switch cover to supply electric power to a starter motor via the movable and fixed contacts. The motor terminal has a head portion, which is integrally formed with one of the fixed contacts, and a shaft portion that protrudes outside the switch cover and is electrically connected to the starter motor.

With the above configuration, it is possible to make electrical connection between the shaft portion of the switch terminal bolt and the battery and between the shaft portion of the motor terminal and the starter motor by using low-cost versatile round terminals. However, at the same time, since both the shaft portions of the switch terminal bolt and motor terminal are exposed to external, the shaft portions are vulnerable to water damage. Consequently, it is difficult to secure reliable electric connection between the shaft portion of the switch terminal bolt and the battery and between the shaft portion of the motor terminal and the starter motor.

Japanese Patent Application Publication No. 2003-208840, an English equivalent of which is U.S. Pat. No. 6,930,576 B1, discloses a starter electromagnetic switch that includes a movable contact, a pair of fixed contacts, a molded-cap (or contact cover), an excitation coil, a current-supply terminal (or excitation coil terminal), and a motor terminal. The molded cap covers the movable contact and has the fixed contacts fixed thereto facing the movable contact. The current-supply terminal is fixed to the molded cap to supply electric current to the excitation coil. The current-supply terminal has one end, which is located inside the molded cap and electrically connected to the excitation coil, and the other end that protrudes outside the molded cap and is held in a connector portion of the molded cap. The motor terminal is also fixed to the molded cap to supply electric power to a starter motor via the movable and fixed contacts. The motor terminal has a head portion, which is integrally formed with one of the fixed contacts, and a shaft portion that protrudes outside the molded cap and is electrically connected to the starter motor.

With the above configuration, since the shaft portion of the current-supply terminal is enclosed by the connector portion of the molded cap, it can be protected from water damage. However, at the same time, different users of engine starters have different requirements for the shapes and sizes of the connector portion and current-supply terminal. Accordingly, the connector portion and current-supply terminal cannot be standardized, thus making it difficult to minimize the manufacturing cost. Moreover, since the shaft portion of the motor terminal is exposed to external, it cannot be protected from water damage.

SUMMARY OF THE INVENTION

The present invention has been made in view of the above-mentioned problems.

According to the present invention, there is provided a starter that includes a motor and an electromagnetic switch. The motor generates torque, when supplied with electric power, to start an engine. The electromagnetic switch controls supply of electric power to the motor. The electromagnetic switch includes a switch case, a movable contact, a fixed contact, a contact cover, an excitation coil, an excitation coil terminal, a motor terminal, and a protective cover. The contact cover is fixed to the switch case and covers the movable and fixed contacts. The excitation coil is provided in the switch case. The excitation coil terminal is fixed to the contact cover and has first and second ends. The first end is located inside the contact cover and electrically connected to the excitation coil. The second end protrudes outside the contact cover so as to be electrically connected to a power source. The motor terminal is fixed to the contact cover and has first and second ends. The first end of the motor terminal is located inside the contact cover and electrically connected to the fixed contact. The second end of the motor terminal protrudes outside the contact cover and is electrically connected to the motor. The protective cover covers both the second end of the excitation coil terminal and the second end of the motor terminal, thereby protecting both the second ends.

With the above configuration, though both the second end of the excitation coil terminal and the second end of the motor terminal protrude outside the contact cover, they still can be protected from water damage by virtue of the protective cover. Consequently, reliable electric connection between the second end of the excitation coil and the power source and between the second end of the motor terminal and the motor can be secured. Moreover, since there is no connector structure employed in the starter, the starter can be standardized, thereby decreasing the manufacturing cost.

BRIEF DESCRIPTION OF THE DRAWINGS

The present invention will be understood more fully from the detailed description given hereinafter and from the accompanying drawings of preferred embodiments of the invention, which, however, should not be taken to limit the invention to the specific embodiments but are for the purpose of explanation and understanding only.

In the accompanying drawings:

FIGS. 11A, 1B, and 11C are side, rear end, and bottom views of a protective cover of the electromagnetic switch of FIG. 10.

DESCRIPTION OF PREFERRED EMBODIMENTS

Figure 1:
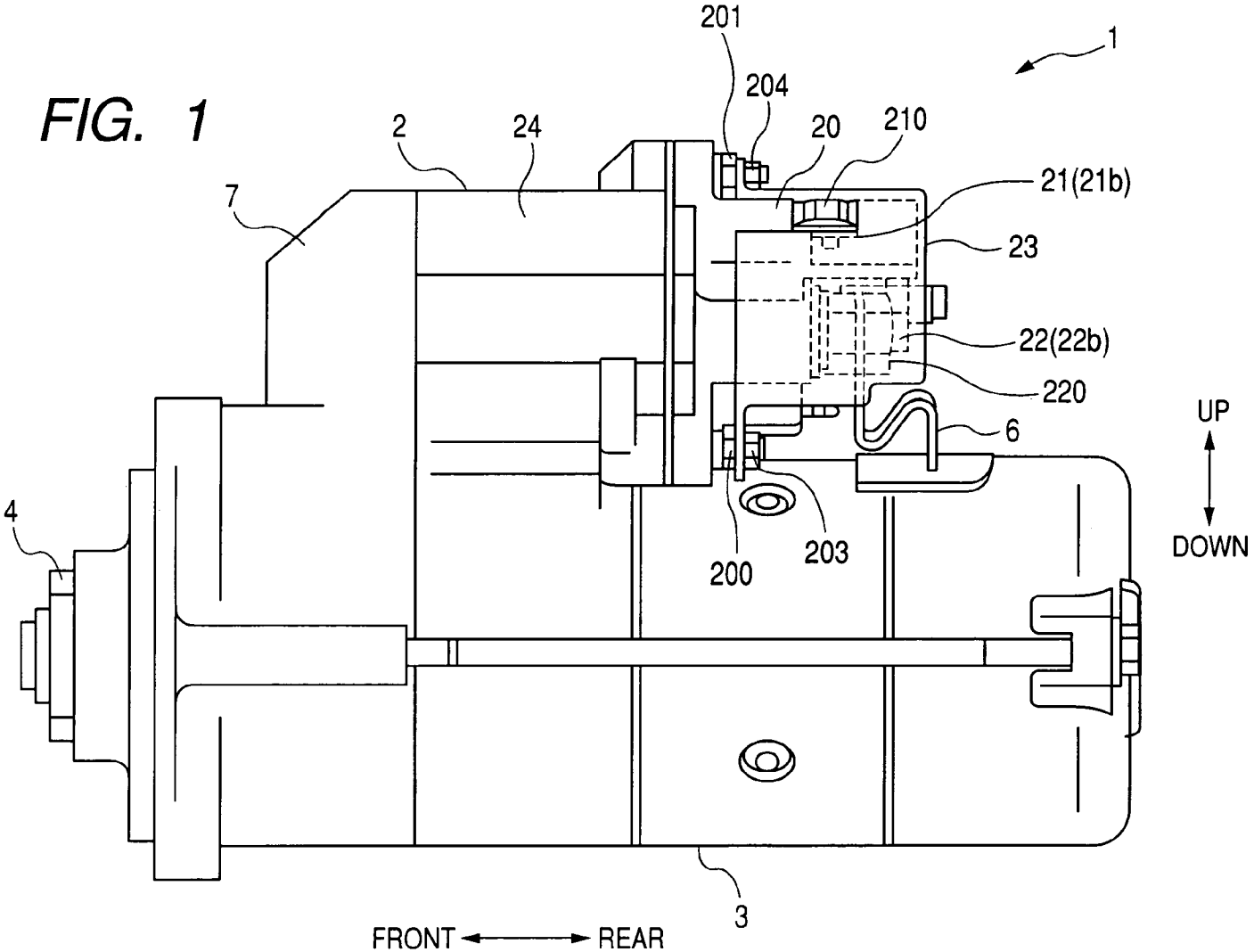
FIG. 1 is a side view of a starter according to the first embodiment of the invention.

Preferred embodiments of the present invention will be described hereinafter with reference to FIGS. 1-12.

It should be noted that, for the sake of clarity and understanding, identical components having identical functions in different embodiments of the invention have been marked, where possible, with the same reference numerals in each of the figures.

First Embodiment

FIGS. 1-7 together show the overall structure of a starter 1 according to the first embodiment of the invention. The starter 1 is designed to start an internal combustion engine of a motor vehicle.

The starter 1 includes an electromagnetic switch 2 and a starter motor 3, as shown in FIG. 1.

The electromagnetic switch 2 controls supply of electric power from a battery (not shown) to the motor 3 and generates a driving force for bringing a pinion 4 into mesh with a ring gear (not shown) of the engine. The electromagnetic switch 2 includes a contact cover 20, an excitation coil terminal 21, and a motor terminal 22, a protective cover 23, a switch case 24, a movable contact 80, a pair of fixed contacts 81 and 82, and an excitation coil 83.

Figure 4:
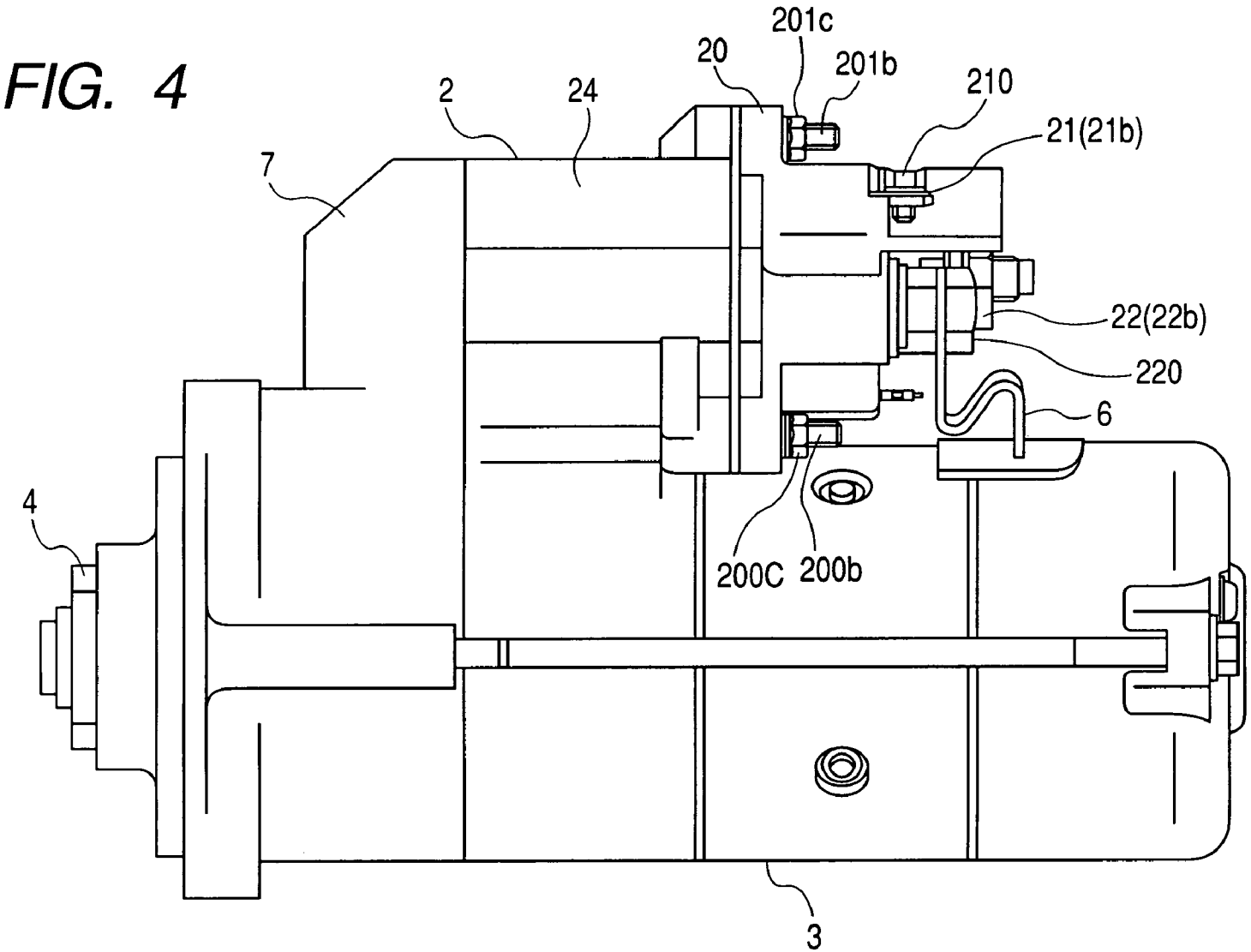
FIG. 4 is a side view of the starter without a protective cover.
Figure 5:
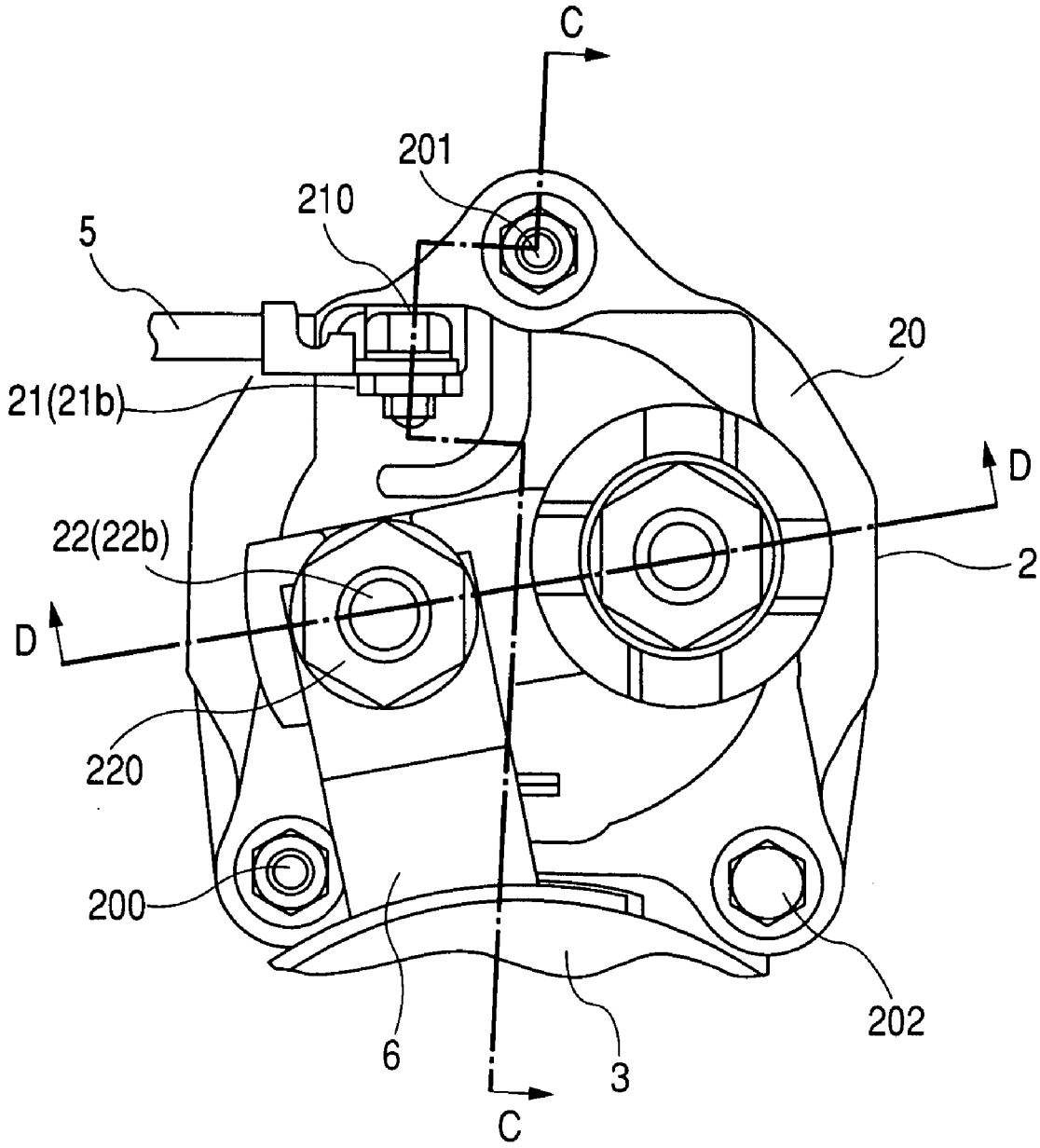
FIG. 5 is a rear end view of the electromagnetic switch without the protective cover.
Figure 6:
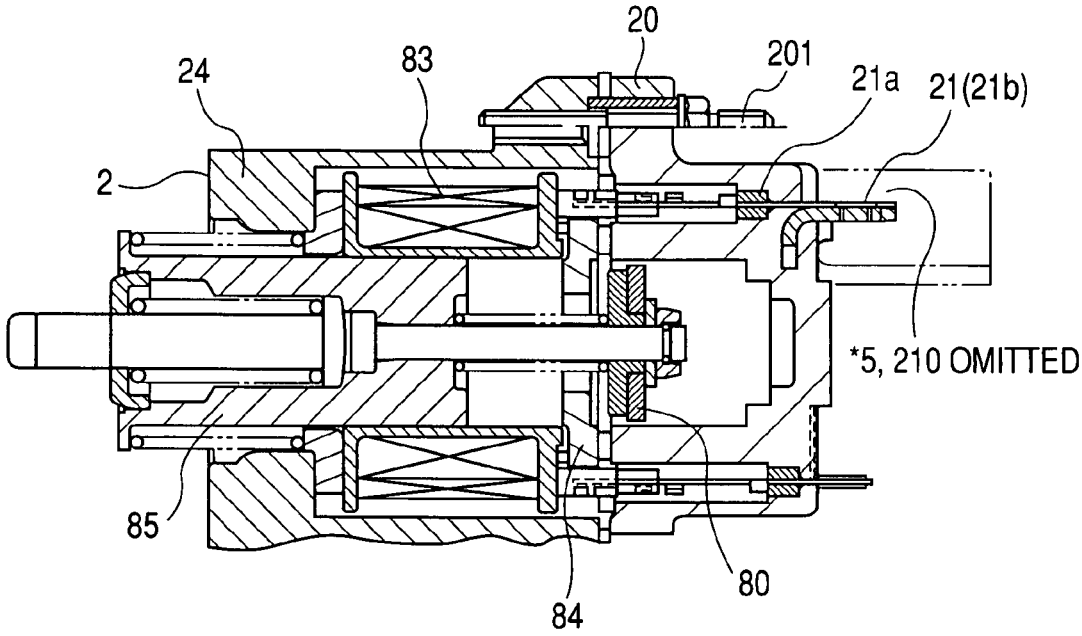
FIG. 6 is a schematic cross-sectional view taken along the line C-C of FIG. 5.
Figure 7:
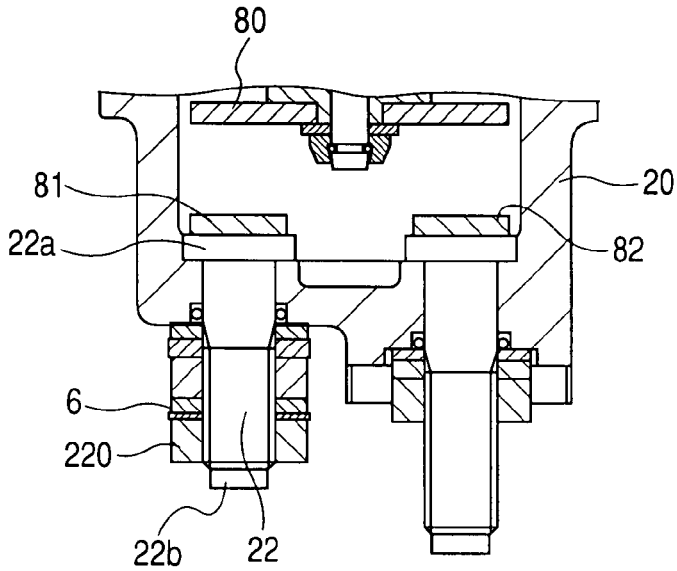
FIG. 7 is a schematic cross-sectional view taken along the line D-D of FIG. 5.

The contact cover 20 has the shape of a cup and is made of an insulative resin. As shown in FIG. 7, the contact cover 20 covers the movable contact 80 and has the fixed contacts 81 and 82 fixed thereto facing the movable contact 80. Further, as best shown in FIGS. 4 and 5, the contact cover 20 is fixed to a rear end of the switch case 24 by means of three bolts 200, 201, and 202. In the switch case 24, as shown in FIG. 6, there is received the excitation coil 83, a core 84, and a plunger 85.

Figure 3:
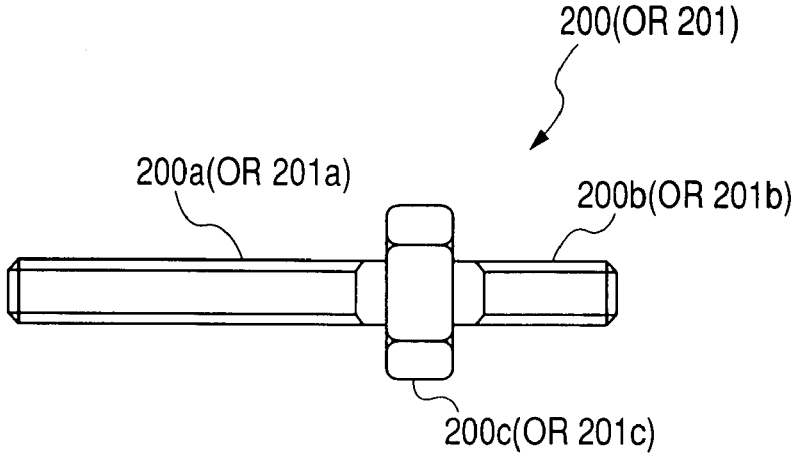
FIG. 3 is a side view of a stud bolt used in the electromagnetic switch.

Among the three bolts, the bolts 200 and 201 are each made up of a stud bolt. Thus, as shown in FIG. 3, the bolt 200 includes a first threaded portion 200*a*, a second threaded portion 200*b*, and a head portion 200*c* interposed between the first and second threaded portions 200*a* and 200*b*; the bolt 201 includes a first threaded portion 201*a*, a second threaded portion 201*b*, and a head portion 201*c* interposed between the first and second threaded portions 201*a* and 201*b*. Further, as shown in FIG. 4, the contact cover 20 is fixed with the first threaded portions 200*a* and 201*a* of the bolts 200 and 201.

The excitation coil terminal 21 is provided to supply electric power from the battery to the excitation coil 83. More superficially, the excitation coil terminal 21 is made of a rectangular conductor and fixed to the contact cover 20, as shown in FIG. 6. The excitation coil terminal 21 has a first end 21*a*, which is located inside the switch case 24 and electrically connected to the excitation coil 83, and a second end 21*b* that protrudes outside the contact cover 20. On the second end 21*b*, as shown in FIGS. 4 and 5, there is fitted a bolt 210, thereby connecting a lead 5 to the excitation coil terminal 21. The lead 5 leads to the battery.

The motor terminal 22 is provided to supply electric power from the battery to the motor 3 via the movable and fixed contacts 80, 81, and 82. More specifically, the motor terminal 22 is made up of a conductive bolt and fixed to the contact cover 20, as shown in FIG. 7. The motor terminal 22 has a first end 22*a*, which is located inside the contact cover 20 and joined to the fixed contact 81, and a second end 22*b* that protrudes outside the contact cover 20. On the second 22*b*, as best shown in FIG. 4, there is fitted a nut 220, thereby connecting a bus bar 6 to the motor terminal 22. The bus bar 6 has almost an "S" shape and is electrically connected to the motor 3.

Figure 2:
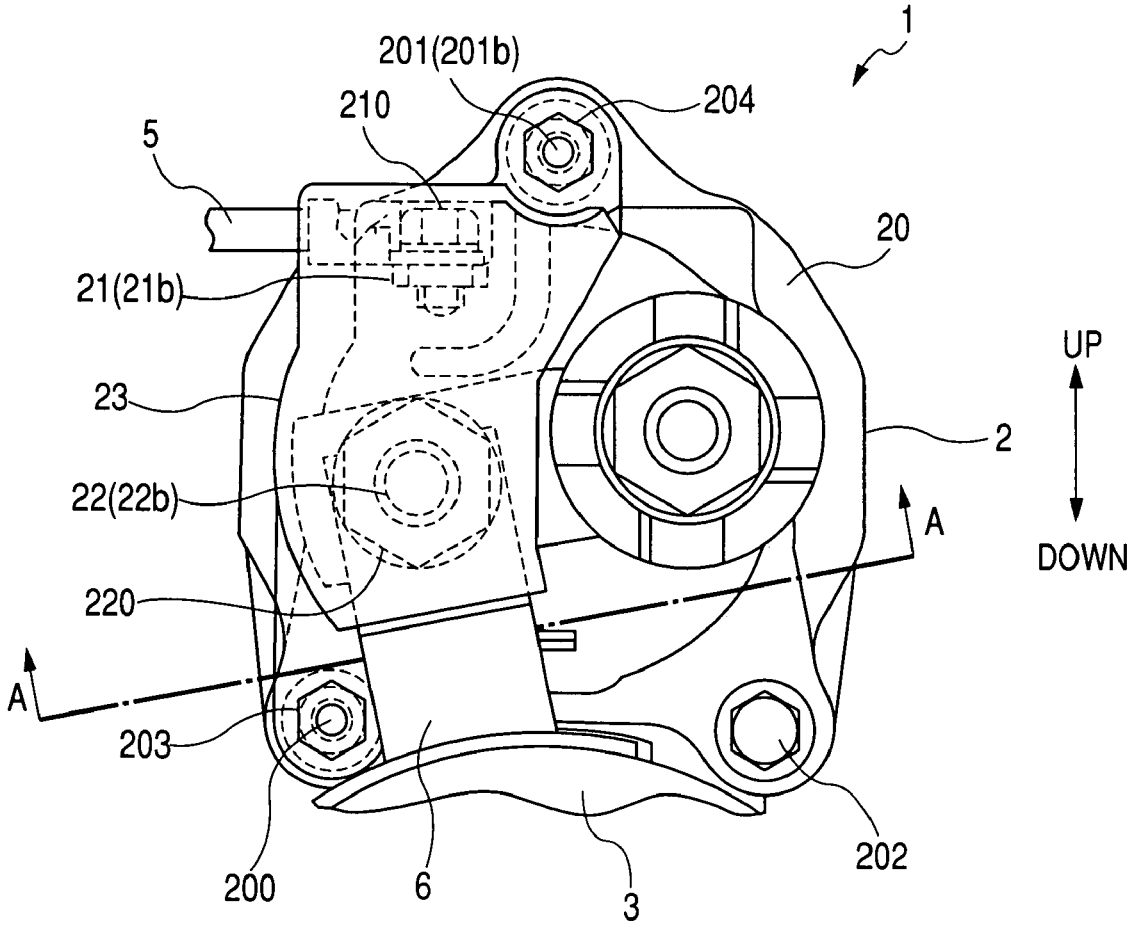
FIG. 2 is a rear end view of an electromagnetic switch of the starter.

The protective cover 23 covers, as shown in FIGS. 1 and 2, both the second end 21*b* of the excitation coil terminal 21 and the second end 22*b* of the motor terminal 22, thereby protecting both the second ends 21*b* and 22*b*.

Figure 8A:
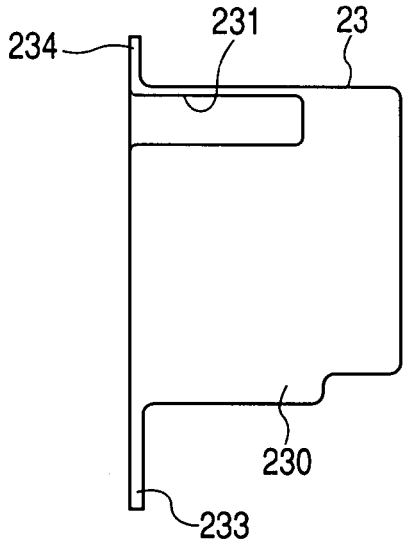
FIGS. 8A, 8B, and 8C are side, rear end, and bottom views of the protective cover, respectively.
Figure 8B:
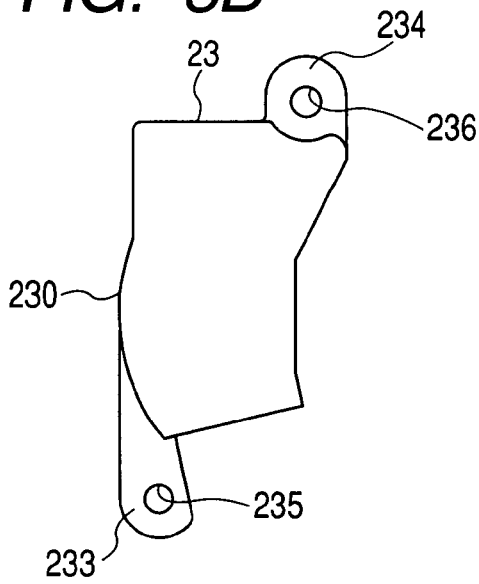
Figure 8C:
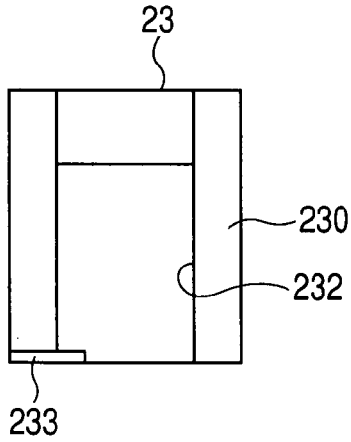
Figure 9:
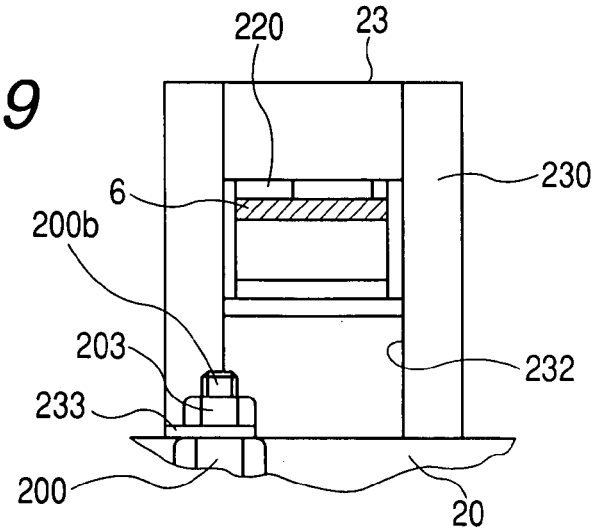
FIG. 9 is a partially cross-sectional view taken along the line A-A of FIG. 2.

More specifically, the protective cover 23 is made of a resin and has the shape of a cup as shown in FIGS. 8A-8C. The protective cover 23 includes a side wall 230 that has a rectangular opening 231, through which the lead 5 is passed to electrically connect the second end 21*b* of the excitation coil terminal 21 to the battery. The side wall 230 also has a rectangular opening 232, through which the bus bar 6 is passed to electrically connect the second end 22*b* of the motor terminal 22 to the motor 3. In the present embodiment, the dimension of the opening 232 is so determined that the protective cover 23 covers the second end 22*b* of the motor terminal 22 without touching the bus bar 6, as shown in FIG. 9.

The protective cover 23 further includes two collar portions 233 and 234 that are diagonally formed, at the open end of the protective cover 23, to extend perpendicular to the side wall 230. The collar portion 233 has a through-hole 235, through which the second threaded portion 200*b* of the bolt 200 is passed to fit with a nut 203, as shown in FIG. 9. On the other hand, the collar portion 234 has a through-hole 236, through which the second threaded portion 201*b* of the bolt 201 is passed to fit with a nut 204, as shown in FIG. 2. In other words, the protective cover 23 is fixed with the second threaded portions 200*b* and 201*b* of the bolts 200 and 201. Moreover, in the present embodiment, the inner diameter of the through-holes 235 and 236 of the collar portions 233 and 234 are set to be slightly smaller than the outer diameter of the second threaded portions 200*b* and 201*b* of the bolts 200 and 201.

Referring back to FIG. 1, the above-described electromagnetic switch 2 is fixed to an upper portion of a rear end surface of a housing 7. The motor 3 is fixed to a lower portion of the rear end surface of the housing 7, adjoining the electromagnetic switch 2. The motor 3 generates torque, when supplied with electric power from the battery, to start the engine.

After having described the overall structure of the starter 1, operation thereof will be described hereinafter.

When an ignition switch (not shown) is turned on, electric power is supplied from the battery to the excitation coil 83 via the lead 5 and the excitation coil terminal 21. Then, the excitation coil 83 creates a magnetic attraction, which causes the plunger 85 to move backward, thereby bringing the pinion 4 into mesh with the ring gear of the engine and the movable contact 80 into contact with the fixed contacts 81 an 82. Upon establishment of the contact between the movable contact 80 and the fixed contacts 81 and 82, electric power is supplied from the battery to the motor 3 via the movable and fixed contacts 80, 81, and 82, the motor terminal 23, and the bus bar 6. With the supplied electric power, the motor 3 generates torque; the generated torque is then transmitted to the ring gear via the pinion 4, thereby starting the engine.

After the engine has started, the ignition switch is turned off, interrupting the electric power supply from the battery to the excitation coil 83. Then, the magnetic attraction disappears; this causes the plunger 85 to move forward to the initial position thereof, thereby detaching the pinion 4 from the ring gear and the movable contact 80 from the fixed contacts 81 and 82. Upon detachment of the movable contact 80 from the fixed contacts 81 and 82, the electric power supply from the battery to the motor 3 is interrupted, bringing the motor 3 into stop.

The above-described starter 1 according to the present embodiment has the following advantages.

In the starter 1, there is provided the protective cover 23 that covers both the second end 21*b* of the excitation coil terminal 21 and the second end 22*b* of the motor terminal 22. Consequently, though both the second ends 21*b* and 22*b* protrude outside the contact cover 20, they still can be protected from water damage by virtue of the protective cover 23. As a result, reliable electric connection between the second end 21*b* and the lead 5 and between the second end 22*b* and the bus bar 6 can be secured. Moreover, since there is no connector structure employed in the starter 1, the starter 1 can be standardized, thereby decreasing the manufacturing cost.

In the present embodiment, the protective cover 23 is fixed to the contact cover 20. Consequently, the protective cover 23 can be securely held in the starter 1 during running of the vehicle.

Further, the protective cover 23 is fixed to the contact cover 20 by means of the bolts 200 and 201 that are also used to fix the contact cover 20 to the switch case 24. Consequently, the parts count of the starter 1 is reduced.

Furthermore, the bolts 200 and 201 are each made up of a stud bolt. More specifically, the bolt 200 has the first threaded portion 200*a* fixed to the contact cover 20 and the second threaded portion 200*b* fixed to the protective cover 23; the bolt 201 has the first threaded portion 201*a* fixed to the contact cover 20 and the second threaded portion 201*b* fixed to the protective cover 23. Consequently, it is possible to attach or detach the protective cover 23 without moving the contact cover 20.

In the present embodiment, the protective cover 23 is made of a resin, and the inner diameter of the through-holes 235 and 236 in the collar portions 233 and 234 of the protective cover 23 are set to be slightly smaller than the outer diameter of the second threaded portions 200*b* and 201*b* of the bolts 200 and 201. Consequently, the relative position of the protective cover 23 with respect to the contact cover 20 can be easily adjusted by adjusting the forces of fastening the nuts 203 and 204 respectively onto the second threaded portions 200*b* and 201*b* of the bolts 200 and 201.

In the present embodiment, the dimension of the opening 232 in the protective cover 23 is so determined that the protective cover 23 covers both the second 21*b* of the excitation coil terminal 21 and the second end 22*b* of the motor terminal 22 without touching the bas bar 6. Consequently, though the bas bar 6 conducts large current to the motor 3, there is no heat conducted from the bas bar 6 to the protective cover 23. Accordingly, it is possible to make the protective cover 23 with a resin that has a lower heat resistance and is thus less expensive.

In the present embodiment, the protective cover 23 is fixed to the contact cover 20 by fitting the nuts 203 and 204 respectively on the second threaded portions 200*b* and 201*b* of the bolts 200 and 201. In other words, the protective cover 23 is fixed to the contact cover 20 at two places that are diagonally positioned with respective to the protective cover 23. Consequently, the protective cover 23 is securely fixed to the contact cover 20, thereby reliably suppressing any displacement and jounce of the protective cover 23 during operation.

Second Embodiment

This embodiment illustrates a starter 8 which has a structure almost identical to that of the starter 1 according to the first embodiment. Accordingly, only the differences between the starters 1 and 8 will be described hereinafter.

Figure 10:
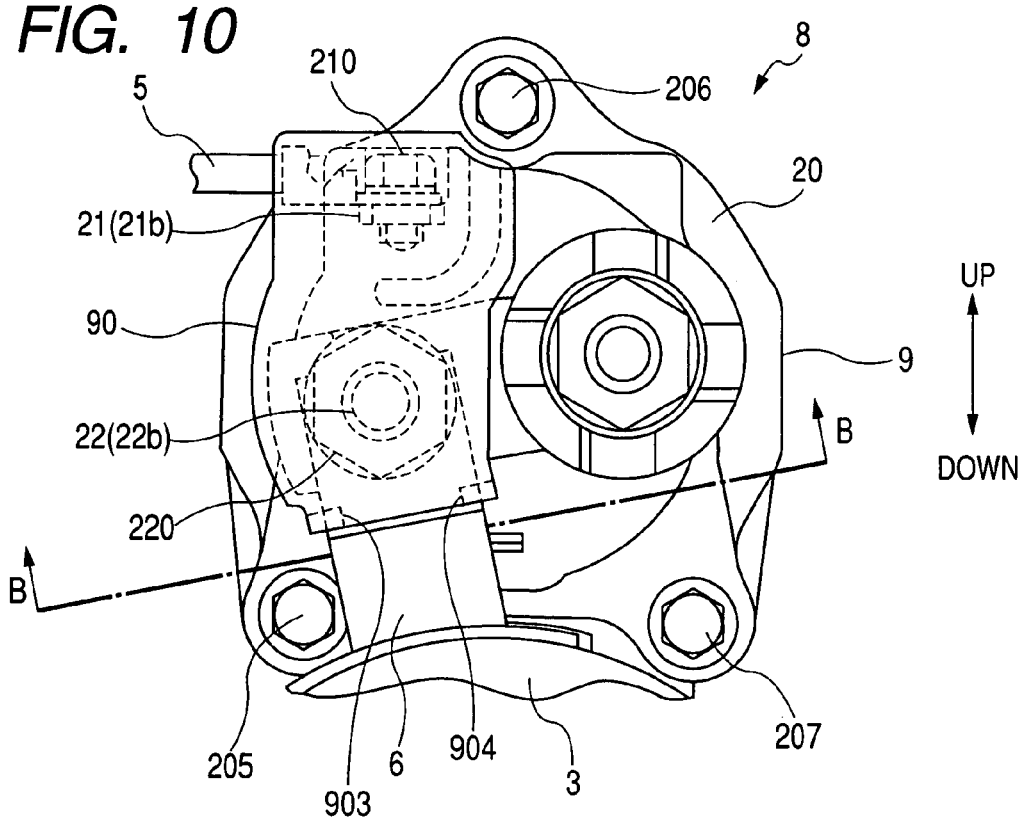
FIG. 10 is a rear end view of an electromagnetic switch of a starter according to the second embodiment of the invention.

As shown in FIG. 10, in the present embodiment, the starter 8 includes the electromagnetic switch 9 and the motor 3. The electromagnetic switch 9 includes the contact cover 20, the excitation coil terminal 21, the motor terminal 22, and a protective cover 90.

The contact cover 20 is fixed to the switch case 24 by means of three bolts 205, 206 and 207. However, unlike in the starter 1 of the first embodiment, none of the three bolts 205-207 is made up of a stud bolt.

Figure 11A:
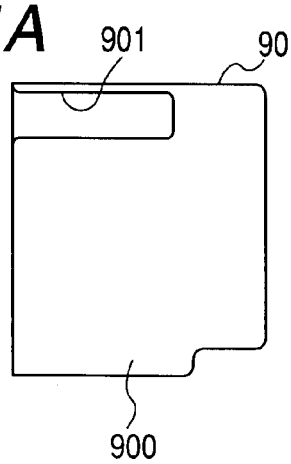
Figure 11B:
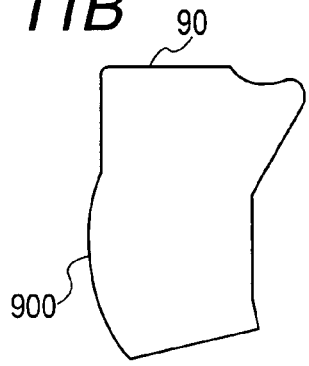
Figure 11C:
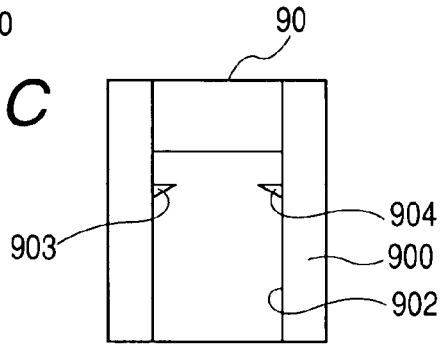

The protective cover 90 is made of a resin that has high heat resistance. The protective cover 90 also has the shape of a cup as shown in FIGS. 11A-11C. The protective cover 90 includes a side wall 900 that has a rectangular opening 901, through which the lead 5 is passed to electrically connect the second end 21*b* of the excitation coil terminal 21 to the battery. The side wall 900 also has a rectangular opening 902, through which the bus bar 6 is passed to electrically connect the second end 22*b* of the motor terminal 22 to the motor 3. The protective cover 90 further includes two claw portions 903 and 904 that are respectively formed on two opposite surfaces of the side wall 900 which define the opening 900.

Figure 12:
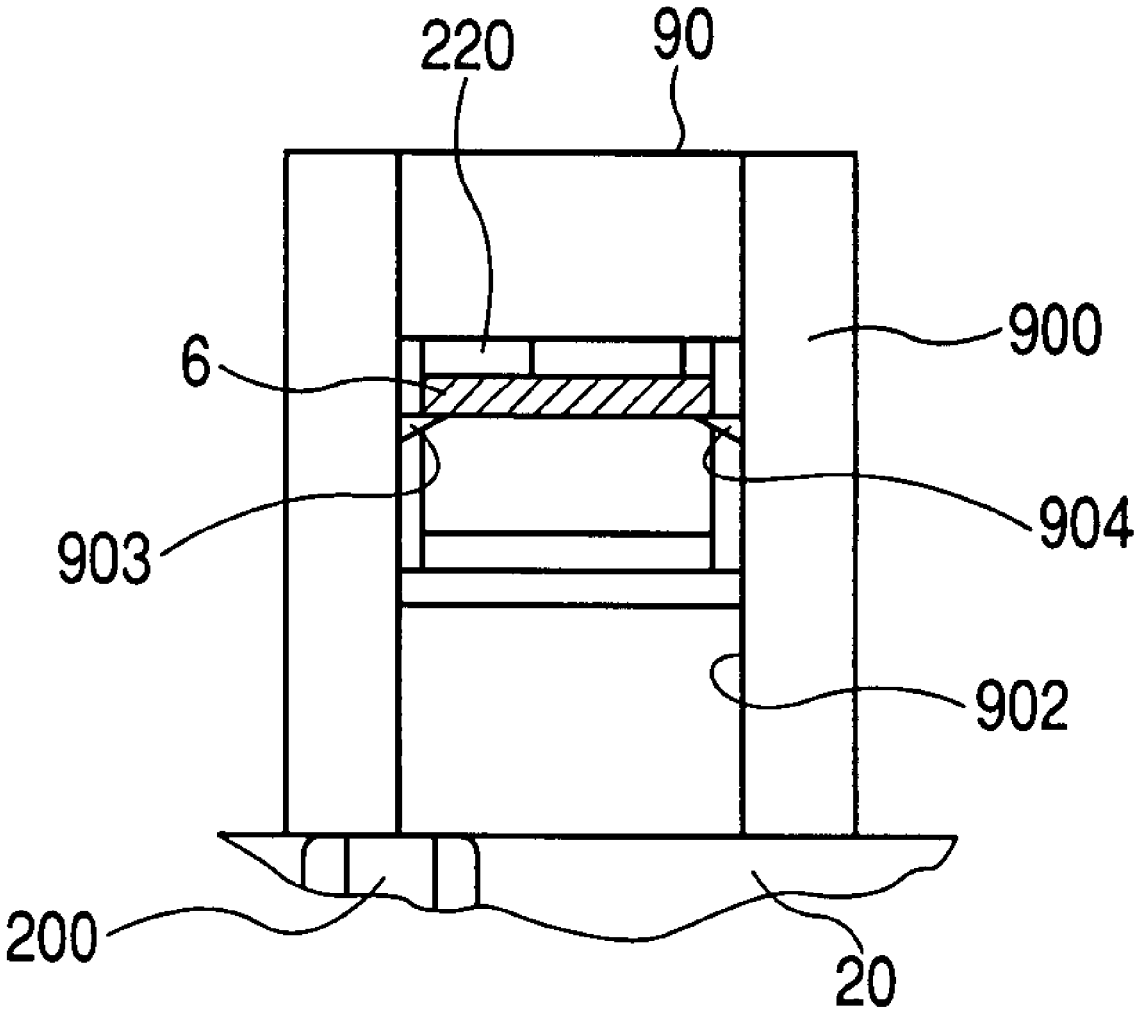
FIG. 12 is a partially cross-sectional view taken along the line B-B of FIG. 10.

As shown in FIG. 10, the protective cover 90 covers both the second end 21*b* of the excitation coil terminal 21 and the second end 22*b* of the motor terminal 22, thereby protecting them. At the same time, as shown in FIG. 12, the claw portions 903 and 904 of the protective cover 90 engage with the bus bar 6, thereby fixing the protective cover 90 to the bus bar 6.

With such a fixing method, the protective cover 90 can be securely fixed only through one-touch operation, thus improving the productivity. In addition, though the protective cover 90 abuts the bus bar 6, it can still be prevented from thermal deformation; this is because the protective cover 90 is made of a resin having high heat resistance.

While the above particular embodiments of the invention have been shown and described, it will be understood by those skilled in the art that various modifications, changes, and improvements may be made without departing from the spirit of the invention.

For example, the protective cover 23 is fixed to the contact cover 20 in the first embodiment, and the protective cover 90 is fixed to the bus bar 6 in the second embodiment. However, the protective cover 23 or 90 may also be fixed to other components having sufficient rigidity, such as the switch case 24 or the motor 3.

What is claimed is:

1. A starter comprising:

a motor that generates torque, when supplied with electric power, to start an engine; and an electromagnetic switch that controls supply of electric power to the motor, the electromagnetic switch including a switch case, a movable contact, a fixed contact, a contact cover fixed to the switch case and covering the movable and fixed contacts, an excitation coil provided in the switch case, an excitation coil terminal fixed to the contact cover and having first and second ends, the first end being located inside the contact cover and electrically connected to the excitation coil, the second end protruding outside the contact cover so as to be electrically connected to a power source, a motor terminal fixed to the contact cover and having first and second ends, the first end of the motor terminal being located inside the contact cover and electrically connected to the fixed contact, the second end of the motor terminal protruding outside the contact cover and being electrically connected to the motor, and a protective cover that covers both the second end of the excitation coil terminal and the second end of the motor terminal, thereby protecting both the second ends, wherein the protective cover is formed in one piece to have a cup shape, wherein the second end of the motor terminal is connected to the motor via a conducting member that is made up of a metal plate, the protective cover is fixed to the conducting member at more than one place, and the protective cover comprises:

a side wall that has an opening through which the conducting member is passed to electrically connect the second end of the motor terminal to the motor; and a plurality of claw portions that are formed on an inside surface of the side wall which defines the opening, the claw portions engaging with the conducting member, thereby fixing the protective cover to the conducting member.

2. The starter as set forth in claim 1, wherein the protective cover is fixed to the contact cover.

3. The starter as set forth in claim 2, wherein the contact cover is fixed to the switch case by means of a plurality of bolts, and the protective cover is fixed to the contact cover also by means of the plurality of bolts.

4. The starter as set forth in claim 3, wherein each of the bolts is made up of a stud bolt to include first and second threaded portions and a head portion interposed between the first and second threaded portions, the contact cover is fixed with the first threaded portions of the bolts, and the protective cover is fixed with the second threaded portions of the bolts.

5. The starter as set forth in claim 2, wherein the protective cover is fixed to the contact cover at more than one place.

6. The starter as set forth in claim 1, wherein the second end of the motor terminal is connected to the motor via a conducting member, and the protective cover covers both the second end of the excitation coil terminal and the second end of the motor terminal without touching the conducting member.

* * * * *